US011326594B2

(12) United States Patent
Garnier et al.

(10) Patent No.: US 11,326,594 B2
(45) Date of Patent: May 10, 2022

(54) STATOR ELEMENT OF A PROGRESSIVE CAVITY PUMP AND PROGRESSIVE CAVITY PUMP

(71) Applicant: PCM TECHNOLOGIES, Levallois-Perret (FR)

(72) Inventors: Pierre Garnier, Chaudefonds sur Layon (FR); Eric Oger, Nuaille (FR)

(73) Assignee: PCM TECHNOLOGIES, Levallois-Perret (FR)

( * ) Notice: Subject to any disclaimer, the term of this patent is extended or adjusted under 35 U.S.C. 154(b) by 0 days.

(21) Appl. No.: 17/057,359

(22) PCT Filed: May 16, 2019

(86) PCT No.: PCT/FR2019/051113

§ 371 (c)(1),
(2) Date: Nov. 20, 2020

(87) PCT Pub. No.: WO2019/224457

PCT Pub. Date: Nov. 28, 2019

(65) Prior Publication Data

US 2021/0190068 A1 Jun. 24, 2021

(30) Foreign Application Priority Data

May 23, 2018 (FR) ..... 1854309

(51) Int. Cl.
*F01C 1/10* (2006.01)
*F03C 2/00* (2006.01)
(Continued)

(52) U.S. Cl.
CPC ..... *F04C 2/107* (2013.01); *F04C 2/1075* (2013.01); *F04C 2240/10* (2013.01); *F04C 2240/20* (2013.01); *F04C 2240/802* (2013.01)

(58) Field of Classification Search
CPC ..... F04C 2/107; F04C 2/1071; F04C 2/1075; F04C 13/008; F04C 2240/10; F04C 2240/20; F04C 2240/802
See application file for complete search history.

(56) References Cited

U.S. PATENT DOCUMENTS 3,514,238 A * 5/1970 Smith ..... F04C 2/1075 418/153
5,145,343 A * 9/1992 Belcher ..... F04C 2/1075 418/48

(Continued)

FOREIGN PATENT DOCUMENTS

DE 3438379 A1 4/1986
EP 0935072 A1 * 8/1999 ..... F04C 2/1075
RU 2402693 C1 9/2010

*Primary Examiner* — Theresa Trieu
(74) *Attorney, Agent, or Firm* — Patzik, Frank & Samotny Ltd.

(57) ABSTRACT

A stator element of a progressive cavity pump having a reinforcement tube having a longitudinal axis, an inner face (22), and an outer face, and an elastomer liner fixed to the inner face of the reinforcement tube, wherein a portion of the reinforcement tube has a substantially constant thickness (e) and in that said portion of the reinforcement tube is deformed such that it comprises at least a first relief pattern and a second relief pattern, the first relief pattern having the shape of a helical strip that is right-handed relative to the longitudinal axis, the second relief pattern having the shape of a helical strip that is left-handed relative to the longitudinal axis, the first and second relief patterns meeting in at least one section.

10 Claims, 3 Drawing Sheets

(51) Int. Cl.

| | |
|---|---|
| ***F03C 4/00*** | (2006.01) |
| ***F04C 2/00*** | (2006.01) |
| ***F04C 2/107*** | (2006.01) |

(56) References Cited

U.S. PATENT DOCUMENTS

| | | | | |
|---|---|---|---|---|
| 6,716,008 | B1 * | 4/2004 | Kachele | F04C 2/1075 418/48 |
| 2007/0128062 | A1 * | 6/2007 | Frisch | F04C 2/1075 418/48 |
| 2007/0140882 | A1 * | 6/2007 | Kachele | F04C 2/1071 418/48 |
| 2011/0150685 | A1 | 6/2011 | Wilbourn | |
| 2015/0056092 | A1 * | 2/2015 | Bindig | F04C 2/1075 418/153 |

* cited by examiner

STATOR ELEMENT OF A PROGRESSIVE CAVITY PUMP AND PROGRESSIVE CAVITY PUMP

BACKGROUND OF THE INVENTION

The present invention falls within the field of progressive cavity pumps used in facilities for pumping oil or gas from deep wells.

In particular, the invention relates to a stator element of a progressive cavity pump and to a progressive cavity pump comprising one or more such stator elements.

Progressive cavity pumps are based on the "Moineau" principle, also known as "Moineau capsulism". These pumps can be used in pump mode (conversion of mechanical energy into hydraulic energy) or in "turbine" or "driving" mode (conversion of hydraulic energy into mechanical energy) for rotating the bit of a drilling motor of oil-producing wells.

Progressive cavity pumps comprise a stator and a helical rotor inserted into the stator.

The stator generally consists of a reinforcement tube made from a rigid material, typically metal or composite. The reinforcement tube is generally cylindrical and has a constant thickness. An elastomer liner is fixed to the interior of this reinforcement tube by means of an adhesive-type bonding system. This liner has a longitudinal helical recess receiving the helical rotor. The helical rotor has one less lobe than the stator, such that sealed cavities are created at the interface between the rotor and the stator. Rotation of the rotor in the stator causes displacement of these cavities and thus makes it possible to pump a fluid.

Under extreme conditions of use, for example such as high pressures, high temperatures, high abrasiveness of the fluid, or high rotational speed of the rotor, the elastomer liner is subjected to significant forces in the axial and orthoradial directions. Under the combined effect of these various stresses, the bonding system applied between the reinforcement tube and the liner may be damaged, lose its adhesion to the inner wall of the reinforcement tube, and sometimes be detached or even expelled from the reinforcement tube.

Such loss of adhesion occurs in particular at the ends of the reinforcement tubes where the elastomer liner ends, allowing infiltration of the pumped fluid at the interface between the reinforcement tube and the liner. Such a defect can lead to complete destruction of the pump's stator and a loss of function when the liner is partially or completely detached from the inner wall of the reinforcement tube.

To overcome this loss of adhesion problem, it is known, in particular from documents US 2011/0150685, CA 2762358, DE 3322095, to create axial grooves or axial projections on the inner wall of a cylindrical reinforcement tube. The reinforcement tube then no longer has a constant thickness over its entire circumference. These axial grooves or these axial projections make it possible to resist orthoradial forces but not to resist axial forces simultaneously.

BRIEF SUMMARY OF THE INVENTION

The object of the present invention is to provide a stator element having an elastomer liner having greater resistance to forces, and in particular capable of withstanding both orthoradial forces and axial forces.

To this end, the invention relates to a stator element of a progressive cavity pump, said stator element comprising:

- a reinforcement tube having a longitudinal axis A-A, an inner face, and an outer face, and

- an elastomer lining fixed to the inner face of the reinforcement tube, characterized in that at least a portion of the reinforcement tube has a substantially constant thickness and in that said portion of the reinforcement tube is deformed such that it comprises at least a first relief pattern and a second relief pattern, the first relief pattern having the shape of a helical strip that is right-handed relative to the longitudinal axis A-A of the reinforcement tube, the second relief pattern having the shape of a helical strip that is left-handed relative to the longitudinal axis A-A of the reinforcement tube, the first relief pattern and the second relief pattern meeting in at least one section.

According to some particular embodiments, the stator element has one or more of the following features:

- The first relief pattern and the second relief pattern meet in several sections, and the intermediate areas located between the first relief pattern and the second relief pattern have the shape of a polygon of at least order 3.
- The first relief pattern and the second relief pattern form grooves on the outer face of the portion of the reinforcement tube.
- The elastomer liner has an outer face fixed to the inner face of the reinforcement tube and an inner face of helical shape having a pitch. The pitch of the helical strip of the first relief pattern is identical to the pitch of the helical shape of the inner face of the elastomer liner.
- The reinforcement tube comprises a cylindrical portion at each end. The stator element comprises at least one axial retaining ring fixed to the cylindrical portion of the stator element, said retaining ring having a radial cross-section of a general U-shape suitable for surrounding a portion of a longitudinal end of the elastomer liner.
- At least one inner face of an axial arm of the retaining ring has sawtooth-shaped protuberances.

The invention also relates to a progressive cavity pump comprising:

- a helical rotor rotatably mounted in the elastomer liner,
- at least first and second stator elements according to the characteristics mentioned above,
- a tubular section fitted, on one side, into said cylindrical portion of the first stator element, and on the other side, into said cylindrical portion of the second stator element, said tubular section bearing, on one side, against the retaining ring of the first stator element, and on the other side, against the retaining ring of the second stator element, said tubular section forming a stop suitable for preventing axial displacement of the retaining rings.

According to some particular embodiments, the progressive cavity pump has one or more of the following features:

- The pump further comprises a tubular end piece having a threaded portion and an opposite portion fitted into another cylindrical portion of the second stator element, said tubular end piece forming a stop preventing axial displacement of the retaining ring.
- The cylindrical portion of the first stator element, the cylindrical portion of the second stator element, and the tubular section are fixed by welding.
- The cylindrical portion of the second stator element and the tubular end piece are fixed by welding.

BRIEF DESCRIPTION OF THE DRAWINGS

The invention will be better understood by reading the following description, given solely as an example and with reference to the figures in which.

DETAILED DESCRIPTION OF THE INVENTION

The invention relates to a stator element and a progressive cavity pump which can be used as a pump or as a drilling motor.

Figure 1:
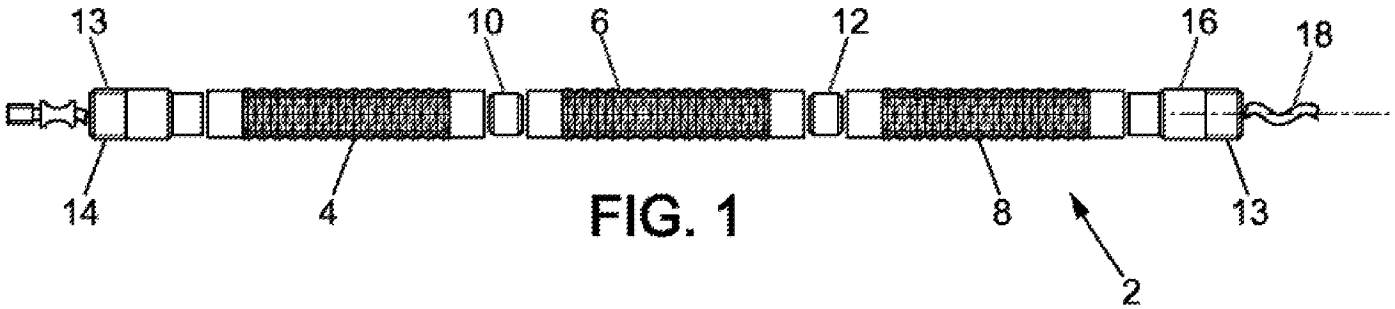
FIG. 1 is an exploded side view of a progressive cavity pump.

With reference to FIG. 1, the progressive cavity pump 2 according to a first embodiment of the invention comprises a first 4, a second 6, and a third 8 stator elements, two tubular sections 10, 12, two tubular end pieces 14, 16, and a helical rotor 18 rotatably mounted in the stator elements, the tubular sections, and the tubular end pieces.

Each tubular section 10, 12 is fitted between two stator elements 4, 6 and 6, 8, and makes it possible to fix the stator elements to one another and to center them relative to one another. The tubular end pieces 14, 16 are fitted into the free ends of the first 4 and third 8 stator elements. They comprise a threaded portion 13 enabling the attachment of the pump 2 to another pump or to a housing of a pumping facility.

The first 4, second 6, and third 8 stator elements are identical. They may be implemented according to a first embodiment illustrated in FIGS. 2 to 4 or according to a second embodiment illustrated in FIGS. 5 to 7.

Figure 2:
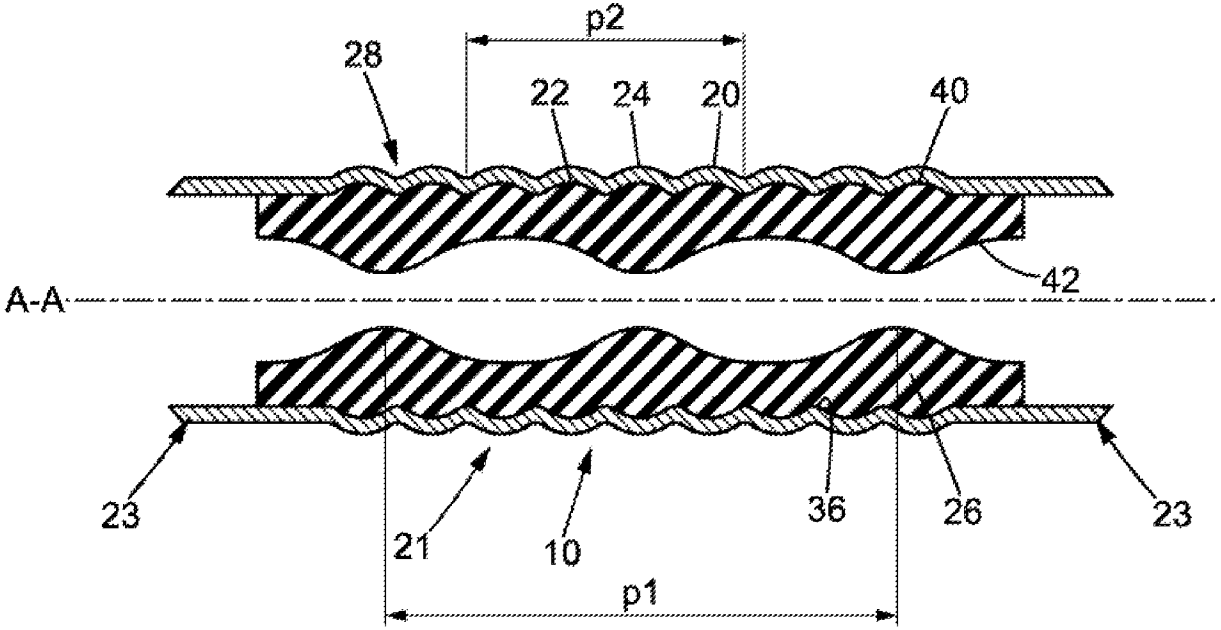
FIG. 2 is a longitudinal section view of a stator element according to a first embodiment of the invention.

Referring to FIG. 2, the first stator element 4 according to the first embodiment comprises a reinforcement tube 20 extending along a longitudinal axis A-A, and an elastomer liner 26 fixed in the reinforcement tube.

The reinforcement tube 20 comprises a deformed central portion 21 and, at each of its ends, a cylindrical portion 23 with a circular base. It has an inner face 22 and an outer face 24.

The elastomer liner 26 has an outer face 40 fixed to the inner face 22 of the reinforcement tube, and an inner face 42 of helical shape having a pitch p1.

Figure 3:
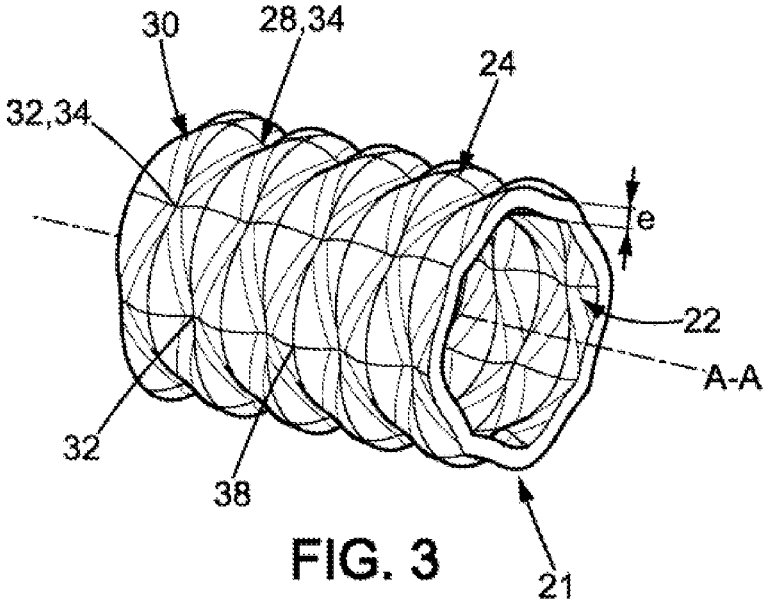
FIG. 3 is a perspective view of a portion of a reinforcement tube of the stator element illustrated in FIG. 2.
Figure 4:
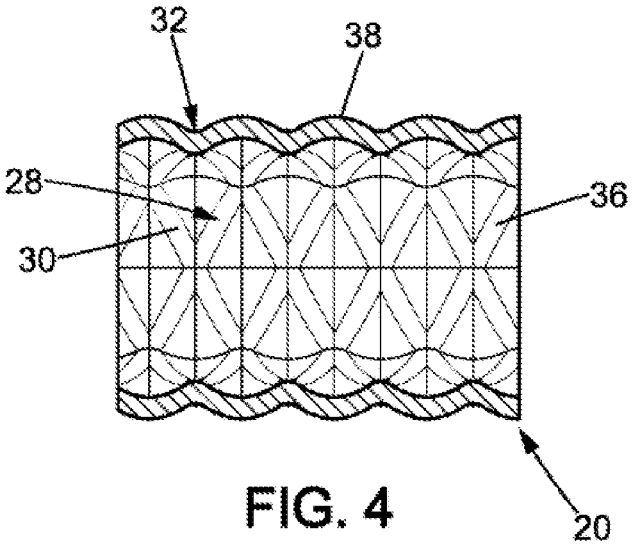
FIG. 4 is a longitudinal section view of the portion of reinforcement tube illustrated in FIG. 3.

Referring to FIGS. 3 and 4, the central portion 21 of the reinforcement tube 20 has a substantially constant thickness e and is deformed such that it comprises a first relief pattern 28 and a second relief pattern 30. The relief patterns 28, 30 may be raised or recessed. They are for example obtained by knurling the inner face 22 or outer face 24 of the central portion of the reinforcement tube. The first 28 and second 30 relief patterns form, on the inner face of the central portion of the reinforcement tube, gripping members for the elastomer liner 26. These gripping members prevent the liner from being pulled off.

In particular, according to the invention the first relief pattern 28 has the shape of a helical strip that is right-handed relative to the longitudinal axis A-A of the reinforcement tube. The second relief pattern 30 is in the form of a helical strip that is left-handed relative to the longitudinal axis A-A of the reinforcement tube. Due to this helical shape and the fact that the handedness of the helical strips are opposite, the first 28 and second 30 relief patterns prevent the elastomer liner from being pulled off regardless of the direction of the forces applied to it. Thus, the integral attachment between the inner face 22 of the reinforcement tube and the outer face 40 of the elastomer liner better withstands the axial and orthoradial forces generated during rotation of the helical rotor 18.

According to the preferred embodiment of the invention illustrated in FIGS. 3 and 4, the relief patterns 28, 30 are formed by recesses on the outer face 24 of the reinforcement tube. These recesses are called helical grooves 34 below. In this example, these helical grooves 34 are produced by knurling the outer face 24 of the reinforcement tube. These helical grooves 34 form helical indentations 36 on the inner face 22 of the reinforcement tube.

The first 28 and second 30 relief patterns meet in several sections 32. Intermediate areas 38 located between the first relief pattern 28 and the second relief pattern 30 have a concavity opposite to the concavity of the first 28 and second 30 relief patterns. Thus, in the embodiment illustrated in FIGS. 3 and 4, the areas 38 form protrusions on the outer face 24 of the reinforcement tube. In this embodiment, these intermediate areas 38 have the shape of a polygon of order 4.

Advantageously, the pitch p2 of the helicoid of the first relief pattern 28 is identical to the pitch p1 of the helicoid of the inner face 42 of the elastomer liner.

The second and third stator elements according to the first embodiment are identical to the first stator element and will not be described in detail.

Alternatively, the relief patterns are constituted by projections which extend outwardly from the anchoring tube and which form recesses on the inner face of the reinforcement tube 20.

Alternatively, the reinforcement tube 20 is deformed such that it comprises a number of relief patterns that is greater than two.

Alternatively, the pitch of the helicoid of the first relief pattern 28 and the pitch of the helicoid of the second relief pattern 30 is substantially greater than or equal to the length of the reinforcement tube 20 such that the first relief pattern 28 and second relief pattern 30 meet in a single section 32.

Alternatively, the areas 38 positioned between the first strip and second strip have the shape of a polygon of order 3.

Figure 5:
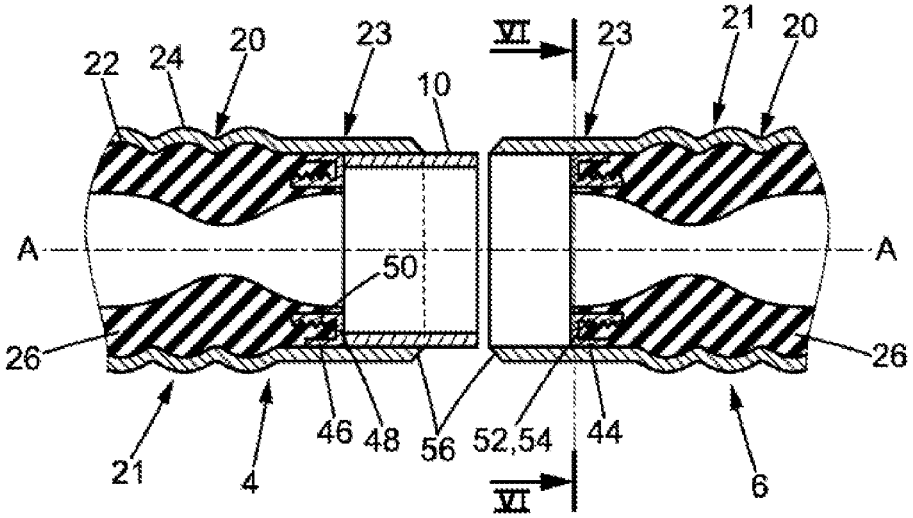
FIG. 5 is a longitudinal section view of a portion of two stator elements according to a second embodiment of the invention, the two stator elements being partially assembled.
Figure 6:
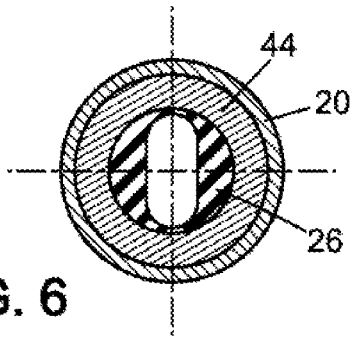
FIG. 6 is a cross-sectional view of the stator element illustrated in FIG. 5, along section plane VI-VI.
Figure 7:
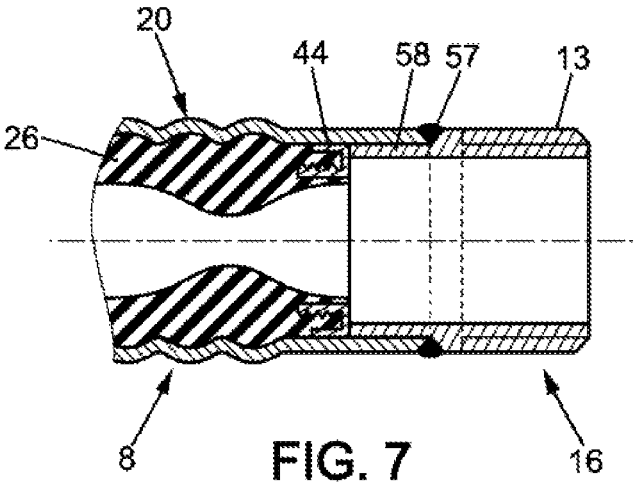
FIG. 7 is a longitudinal section view of an assembly of a portion of a stator element according to the second embodiment and a tubular end piece.

FIGS. 5 to 7 represent stator elements according to a second embodiment of the invention. In particular, FIG. 5 represents a first 4 and a second 6 stator element which are partially assembled to the tubular section 10.

The first, second, and third stator elements according to the second embodiment of the invention are similar to the first, second, and third stator elements according to the first embodiment except for the existence of two retaining rings 44 fixed in each stator element.

The parts of the stator elements according to the second embodiment which are identical to the parts of the stator elements according to the first embodiment have the same references and will not be described a second time.

With reference to FIGS. 5 and 6, the retaining rings 44 of the first 4 and second 6 stator elements are able to delay infiltration of the fluid pumped between the reinforcement tube 20 and the elastomer liner 26. They retain the longitudinal ends of the elastomer liner 26 against the inner face 22 of the reinforcement tube.

The retaining rings 44 are fixed in each cylindrical portion 23 of the reinforcement tube 20, coaxially with the longitudinal axis A-A. In practice, the elastomer liner 26 is shaped by injecting an uncured elastomer mixture into the reinforcement tube 20 when the latter is equipped with two retaining rings 44.

The retaining rings 44 have a U-shaped cross-section suitable for surrounding a portion of the longitudinal end of the elastomer liner 26. The U-shaped radial cross-section of the retaining rings comprises an outer axial arm 46, a central radial arm 48, and an inner axial arm 50.

The outer axial arm 46 is fixed to the inner face 22 of the cylindrical portion 23 of the reinforcement tube. The central radial arm 48 forms an axial stop for the tubular section 10 during assembly of the first 4 and second 6 stator elements.

An inner face 52 of the inner axial arm 50 comprises sawtooth-shaped protuberances 54 suitable for retaining the elastomer of the liner 26.

The retaining rings 44 form stops preventing axial displacement of the elastomer liner 26 and thus delay its pulling loose.

When the first stator element 4, the tubular section 10, and the second stator element 6 are assembled and secured together by applying a welding material at the chamfers 56, the tubular section 10 in turn forms a stop preventing axial displacement of the retaining ring 44 of the first stator element and of the retaining ring 44 of the second stator element.

With reference to FIG. 7, the third stator element 8 is fixed to the tubular end piece 16 by a weld 57. The tubular end piece 16 has a threaded portion 13 and an opposite portion 58 fitted into the cylindrical portion 23 of the second stator element 6. As can be seen in this figure, the retaining ring 44 bears against the tubular end piece 16. When the tubular end piece 16 is welded to the third stator element, the tubular end piece 16 forms a stop preventing axial displacement of the retaining ring 44.

The invention claimed is:

1. A stator element of a progressive cavity pump, said stator element comprising:

a reinforcement tube having a longitudinal axis, an inner face and an outer face, and an elastomer liner fixed to the inner face of the reinforcement tube, wherein at least a portion of the reinforcement tube has a substantially constant thickness and said portion of the reinforcement tube is deformed such that it comprises at least a first relief pattern and a second relief pattern, the first relief pattern having the shape of a helical strip that is right-handed relative to the longitudinal axis of the reinforcement tube, the second relief pattern having the shape of a helical strip that is left-handed relative to the longitudinal axis of the reinforcement tube, the first relief pattern and the second relief pattern meeting in at least one section.

2. The stator element according to claim 1, wherein the first relief pattern and the second relief pattern meet in several sections, and wherein intermediate areas located between the first relief pattern and the second relief pattern have the shape of a polygon of at least order 3.

3. The stator element according to claim 1, wherein the first relief pattern and the second relief pattern form grooves on the outer face of the portion of the reinforcement tube.

4. The stator element according to claim 1, wherein the elastomer liner has an outer face fixed to the inner face of the reinforcement tube and an inner face of helical shape having a pitch, and wherein a pitch of the helical strip of the first relief pattern is identical to the pitch of the helical shape of the inner face of the elastomer liner.

5. The stator element according to claim 1, wherein the reinforcement tube comprises a cylindrical portion at each end and wherein said stator element comprises at least one axial retaining ring fixed to the cylindrical portion of the stator element, said axial retaining ring having a radial cross-section of a general U-shape suitable for surrounding a portion of a longitudinal end of the elastomer liner.

6. The stator element according to claim 5, wherein at least one inner face of an axial arm of the axial retaining ring has sawtooth-shaped protrusions.

7. A progressive cavity pump comprising:

a helical rotor rotatably mounted in the elastomer liner, at least first and second stator elements according to claim 5, and a tubular section fitted, on one side, into said cylindrical portion of the first stator element, and on the other side, into said cylindrical portion of the second stator element, said tubular section bearing, on one side, against the axial retaining ring of the first stator element, and on the other side, against the axial retaining ring of the second stator element, said tubular section forming a stop suitable for preventing axial displacement of the axial retaining rings.

8. The progressive cavity pump according to claim 7, further comprising a tubular end piece having a threaded portion and an opposite portion fitted into another cylindrical portion of the second stator element, said tubular end piece forming a stop preventing axial displacement of the axial retaining ring.

9. The progressive cavity pump according to claim 8, wherein the cylindrical portion of the second stator element and the tubular end piece are fixed by welding.

10. The progressive cavity pump according to claim 7 wherein the cylindrical portion of the first stator element, the cylindrical portion of the second stator element, and the tubular section are fixed by welding.

* * * * *